US006447208B1

(12) United States Patent
Huang et al.

(10) Patent No.: US 6,447,208 B1
(45) Date of Patent: Sep. 10, 2002

(54) EXTENDED BASE TENSION LEG SUBSTRUCTURES AND METHOD FOR SUPPORTING OFFSHORE PLATFORMS

(75) Inventors: Edward W. Huang; Bambang A. Sarwono, both of Houston; Ngok W. Lai, Spring, all of TX (US)

(73) Assignee: ABB Lummus Global, Inc., Houston, TX (US)

( * ) Notice: Subject to any disclaimer, the term of this patent is extended or adjusted under 35 U.S.C. 154(b) by 0 days.

(21) Appl. No.: 09/609,885

(22) Filed: Jul. 5, 2000

Related U.S. Application Data

(60) Provisional application No. 60/142,839, filed on Jul. 8, 1999.

(51) Int. Cl.[7] ..... E02D 5/74; B63B 35/44

(52) U.S. Cl. ..... 405/224; 405/195.1; 405/223.1; 405/224.2; 114/265

(58) Field of Search ..... 405/195.1, 203, 405/204, 223, 223.1, 224, 224.1–224.4; 114/264, 265, 230; 166/341, 342, 353, 354; 52/223.13

(56) References Cited

U.S. PATENT DOCUMENTS

| | | | | | |
|---|---|---|---|---|---|
| 3,490,406 | A | * | 1/1970 | O'Reilly et al. | 114/265 |
| 3,540,396 | A | * | 11/1970 | Horton | 114/265 |
| 3,577,946 | A | * | 5/1971 | Horton | 114/265 |
| 3,919,957 | A | * | 11/1975 | Ray et al. | 114/265 |
| 3,982,492 | A | * | 9/1976 | Steddum | 114/265 |
| 4,436,050 | A | * | 3/1984 | Liden | 114/265 |
| 4,498,412 | A | | 2/1985 | Liden | 114/267 |
| 4,844,659 | A | * | 7/1989 | Hunter et al. | 405/224 |
| 4,861,196 | A | * | 8/1989 | Folse | 405/224 |
| 4,913,591 | A | * | 4/1990 | Steele | 405/224 X |
| 4,938,632 | A | * | 7/1990 | Eie | 405/224 |
| 5,147,148 | A | * | 9/1992 | White et al. | 405/223.1 X |
| 5,330,293 | A | | 7/1994 | White et al. | 405/211 |
| 5,421,676 | A | * | 6/1995 | Wybro et al. | 405/223.1 |
| 5,575,592 | A | * | 11/1996 | Pollack | 405/223.1 |
| 5,931,602 | A | | 8/1999 | Gulbrandsen et al. | 405/224 |
| 5,964,550 | A | * | 10/1999 | Blandford et al. | 405/224 |
| 6,190,089 | B1 | * | 2/2001 | Bennett, Jr. et al. | 405/195.1 X |

FOREIGN PATENT DOCUMENTS

| | | | | |
|---|---|---|---|---|
| WO | WO-9520074 A1 | * | 7/1995 | |
| WO | WO 95/20074 | | 7/1995 | E02B/17/00 |
| WO | WO 97/45318 | | 12/1997 | B63B/21/50 |
| WO | WO-9745318 A1 | * | 12/1997 | |
| WO | WO 99/00293 | | 1/1999 | B63B/21/50 |
| WO | WO-9900293 A1 | * | 1/1999 | |

* cited by examiner

*Primary Examiner*—Heather Shackelford
*Assistant Examiner*—Jong-Suk Lee
(74) *Attorney, Agent, or Firm*—Robert W Strozgier; Alan H. Gordon

(57) ABSTRACT

An extended-base tension leg substructure, an offshore platform supported on the substructure and a method for supporting an offshore platform on the substructure are disclosed, where the substructure includes a plurality of support columns disposed about a central axis of the substructure and interconnected by at least one pontoon. Each column comprises an above water and submerged portion. The substructure also includes a plurality of wings or arms radiating from the columns and/or the pontoons, each wing fixedly or removably securing at least one tendon extending from a wing to an anchor on the seabed. The substructure includes an open, wave transparent central zone for improved access to well-related equipment, conduits or the like and the wings minimize translational movement and rotational flex in the substructure reducing fatigue in the tendons and their connections.

28 Claims, 11 Drawing Sheets

EXTENDED BASE TENSION LEG SUBSTRUCTURES AND METHOD FOR SUPPORTING OFFSHORE PLATFORMS

This application claims the benefit of U.S. Provisional Application No. 60/142,839, Jul. 8, 1999.

BACKGROUND OF THE INVENTION

1. Field of the Invention

The present invention relates to a compact extended-base tension leg platform (the term tension leg platform is sometimes referred to as a "TLP") substructure for supporting an offshore platform. The apparatus of the invention includes a plurality of support columns disposed about an open zone centered about a central axis of the substructure, a plurality of interconnecting pontoons, a plurality of stabilizing wings or arms for fixedly or removably securing a plurality of tendons anchored to the seabed, where columns are preferably symmetrically disposed about the central axis.

More particularly, the present invention relates to a compact extended-base tension leg substructure for supporting a platform which includes a plurality of support columns disposed about an open, wave transparent zone centered about a central axis of the substructure where adjacent columns are interconnected by at least one pontoon, where columns are preferably symmetrically disposed about the central axis. The substructure also includes a plurality of stabilizing wings or arms radiating outwardly from the columns and/or pontoons, where each wing is designed to fixedly or removably secure at least one tendon anchored to the seabed. Each column comprises an above water and submerged portion. The apparatus of the substructure minimizes or at least reduces translational movement and rotational flex in the substructure thereby reducing flex fatigue in the tendons anchoring the substructure to the seabed. The apparatus also de-couples tendon spacing and column spacing The present invention also relates to platforms incorporating the substructure, methods for making the substructure, methods for mooring an offshore platform, and methods for reducing the fatigue and extending the useful life of the anchoring tendons and connections.

2. Description of the Related Art

Many substructures have been described in the prior art. Many of these substructures are so-called large platform support structures that anchor to the seabed by means of an array of tendons. These tendons form a pattern that define the boundaries of a relatively large area of the seabed. Compact substructures are also known in the art, but they generally employ a central column with radially disposed arms. Such large and compact platforms are disclosed in the following U. S. Pat. Nos: 3,982,492, 4,421,436, 4,793,738, 4,913,233, 4,938,632, 4,983,073, 5,147,148, 5,381,865, 5,421,676, 5,431,511, 5,433,273, 5,549,164, 5,507,598, 5,567,086, 5,669,735, and 5,775,846, incorporated herein by reference. However, these structures do not include features of the present invention. For example, these structures do not include an array of arms or wings that radiate outwardly from a multi-columned, wave transparent substructure that minimizes or at least reduces the fatigue of the anchoring tendons. Thus, there is a need in the art for a multi-columned, compact, wave transparent substructure that minimizes or at least reduces tendon fatigue and that has an anchoring pattern on the seabed similar to a large tension leg platform substructure.

SUMMARY OF THE INVENTION

The present invention provides a compact, multi-columned, centrally wave transparent extended-base tension leg platform substructure for supporting an offshore platform. The apparatus of this invention includes a plurality of support column disposed about an open zone centered about a central axis of the substructure and at least one buoyant pontoon interconnecting adjacent columns where the columns are designed to engage and support a platform, where columns are preferably symmetrically disposed about the central axis. In operation each column has a submerged and a non-submerged portion and, along with buoyant pontoons, which are submerged, can be, and preferably are made selectively buoyant by means of ballast control. The substructure also includes at least one wing or arm fixedly attached to or integral with each column or each pontoon. Each wing or arm is attached to at least one tendon that is anchored to the seabed. The wings can be closed, opened or mixed structures (closed and opened parts), where the closed wings or wing parts can be separately ballasted.

The present invention also provides a compact TLP substructure for supporting an offshore platform which includes a plurality of support column forming an opened, wave transparent zone centered about a central axis of the substructure where adjacent columns are interconnected by buoyant pontoons, where columns are preferably symmetrically disposed about the central axis. The substructure also includes a plurality of wings or arms radiating out from the columns and/or pontoons, where each wing fixedly or removably secures at least two tendons anchored to the seabed, with each tendon engaging an opposite lateral side of a wing or arm. Each column includes an above water and submerged portion and, along with the buoyant pontoons, which are submerged, can be, and preferably are made selectively buoyant by means of ballast control. The substructure is designed to minimize translational movement and rotational flex in the substructure thereby reducing flex fatigue in the tendons anchoring the substructure to the seabed and to reduce flex fatigue in the connection members that attach the tendons to the wings and to decouple the tendon porch horizontal separation from the topside deck dimension. The substructure is also designed to provide a sufficient moon pool dimension to accommodate conventional top tensioned risers and direct vertical access to wells.

The present invention also provides a work platform and an equipment platform supported by the substructure of the present invention which includes platforms fixedly or removably attached to the substructure, previously described, the substructure, and the tendons anchored to the seabed. The platform can support drilling equipment, well completion equipment, risers extending from a well bore at the sea floor and upwardly through the open zone of the substructure to the platform, and other well-related equipment.

The present invention also provides a method for supporting and mooring an offshore platform to reduce fatigue in the anchoring tendons and their connections, the method including the steps of supporting an offshore platform on a substructure of the present invention, ballasting the substructure so that portions of the columns of the substructure are above the water and portions of the columns are below the water, and positioning a plurality of tendons so they are anchored at one end to the seabed and attached at another end to wings on the substructure.

The present invention further provides a method for making the substructures of the present invention including the steps of interconnecting adjacent support columns with at least one submergable pontoon, attaching at least one wing to each column or pontoon, attaching tendons at one end to the wing and at another end to a seabed anchor.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
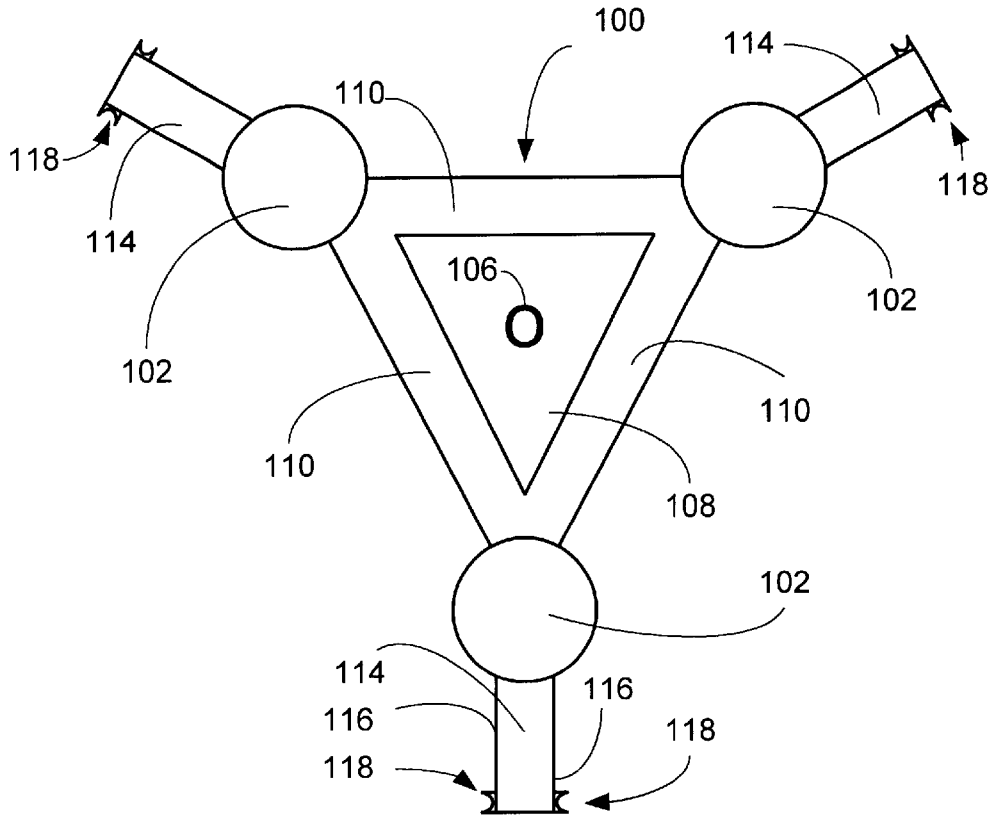
FIG. 1A depicts a top view of a first preferred embodiment of an extended-base tension leg platform support structure in accordance with the present invention.

A compact support substructure for a TLP may be constructed that incorporates a tendon support pattern similar in geometry to larger or full-sized support structures. The substructure provides wave transparence in an open internal region centered about a central axis and a plurality of greater than two of buoyant support columns disposed about the central axis, where columns are preferably symmetrically disposed about the central axis. Adjacent columns are interconnected by at least one buoyant pontoon. The columns or pontoon(s) have buoyant wings or arms radiating therefrom. Each wing has a means for attaching at least one tendon that is anchored to the seabed. These wings help to stabilize the compact substructure, improve the hull weight efficiency when compared to a conventional TLP, minimize wave and current loading on the columns and pontoons or hull, improve tendons fatigue life, improve fatigue life at the top and bottom connectors of tendons rendering greater flexibility in component design, decouple the tendon porch horizontal separation from the topside deck dimension, reduce platform heave, roll and pitch natural periods, and reduce ballast requirements for maintaining even tendon tension. By optimizing column spacing, this invention facilitates the reduction of deck structure steel weight and provides improved stability for hull installation and transportation. The structures of the present invention can also provide a sufficient moon pool dimension to accommodate conventional top tensioned risers and direct vertical access to wells. The structure also allows optimization of the underwater-column-volume-to-pontoon-volume ratio to improve hydrodynamic cancellation effect. Pre-installed structures can provide a stabilized platform for later deck installation or construction.

Broadly, the present invention includes a compact support substructure including at least three support columns disposed about a central axis, where columns are preferably symmetrically disposed about the central axis. The substructure is designed to support an offshore platform. In preferred form, the invention includes a plurality of submergible buoyant pontoons, at least one pontoon interconnecting each pair of adjacent columns at a submerged location on each column and a plurality of wings radiating outwardly from each column and/or each pontoon. Each wing has attached at least one tendon connector. Preferably, the wings are symmetrically disposed about the central axis of the structure.

Broadly, the present invention also relates to a method for mooring an offshore platform including the steps of anchoring at one end a plurality of tendons on the seabed, securing the other end of the tendons to wings attached to a substructure of the present invention, and attaching a platform to tops of a plurality of buoyant columns of the substructure, the columns interconnected by a plurality of buoyant pontoons.

Broadly, the present invention also relates to a method of improving fatigue life of subsea tendons including the steps of forming a plurality of buoyant columns, interconnecting the plurality of columns with a plurality of generally horizontally disposed buoyant pontoons to form a controllably buoyant substructure, attaching a plurality of arms about an outer perimeter of the substructure, the arms having a proximal and a distal end, securing one end of the tendons to the distal end of each of the arms, and securing the other end of the tendons to the seabed.

The wings or arms are design to improve the overall stability of the substructure and to reduce motion relative to the seabed caused by wave, current and air action on the substructure and attached tendons. The reduced motion (translational or rotational or heave, roll and yaw) causes reduced moments on the tendons and both seabed and substructure tendon connections thereby improving tendon and connection lifetime by decreasing flex fatigue due to relative motion of the substructure relative to the seabed.

Generally, the wings increase a radial extension of the substructure between about 10% and about 100%, where the term radial extension of the substructure means the distance from the central axis of the substructure to a point on the outer perimeter of the substructure defined generally by the pontoons. Thus, if the wings are affixed to the columns, then the wings would increase the distance from the central axis to an outward surface of the column by an amount between about 10% and about 100%. Preferably, the wings extend the radial extension of the substructure from about 10% to about 75% and particularly from about 25% to about 75%, but lesser and greater radial extension are also contemplated.

The columns are generally of a larger diameter or dimension than the pontoons or the wings. However, the three elements can be dimensioned similarly. Moreover, the exact shape of the columns, pontoons and wings are a matter of design criteria and choice. Any regular or irregular geometric shape is acceptable including, without limitation, shapes having a circular cross-section, a square cross-section, a rectangular cross-section, an oval cross-section, a triangular cross-section, a pentagonal or other polygonal cross-sections or the like. Preferably, the columns have either a circular cross-section, a square cross-section or a five-sided cross-section or a polygonal cross-section. Preferably, the pontoons have a circular cross-section, a square cross-section or a rectangular cross-section or a polygonal cross-section.

The substructures of the present invention are preferably constructed with the columns disposed symmetrically about a central axis of the substructures. However, non-symmetrically disposed columns are also within the scope of this invention. Non-symmetrical column arrangements may be less sensitive to some types of regularly repeating Specification or periodic forces. Generally, the substructures include at least three columns. Preferred substructures includes three or four columns. For three column substructures, the columns are disposed about the central axis of the substructure to form a triangle. Preferably, the triangle is an equilateral triangle, but other triangular arrangements are anticipated as well such as isosceles triangles, right triangles or general triangle. For four or more column substructures, the columns are disposed about the central axis of the substructure in a polygonal arrangement. For four column substructures, the polygonal arrangement is preferably symmetrical such as a square, rectangle or parallelogram; but general four-sided polygons or quadrilaterals are anticipated as well including trapezoids and quadrilaterals having four different internal angles. For higher columned structures, the columns are deposed about the central axis of the substructure in a polygonal arrangement. Moreover, although closed polygonal arrangements are preferred, opened polygonal arrangements are also anticipated. In opened polygonal arrangements, one of the interconnecting pontoons is missing allowing large scale access to the interior of the substructure.

The wings can be an opened structure, a closed structure or mixed structure having opened and closed parts. The closed structures can be buoyant so that they may be separately ballasted. Opened wings can comprises truss structures or beams with reinforcing cross-members. Closed wings can comprises welded or continuous structures that can be fully or partially flooded.

The substructures of the present invention can also include ballast pumps associated with the columns, pontoons and/or wings to collectively or individually control the ballast of each such component or the entire substructure. Ballast control facilitates tension control of the tendons and enables the installation and platform attachment and/or exchange to proceed smoothly.

The platform connectors and tendon connectors and the connection made between the substructure and the platform or tendon can be any connector or connection commonly used in the art including, without limitation, connectors that can be welded and any other type of welded connections, any type of locking connections, or the like.

Tendon connector placement is also a design criteria or choice. Generally, the tendon connectors are located at or near the outward or distal ends of the wings. Preferably, the connectors are located either on the distal end of each wing or on the sides of each wing at or near the distal end of each wing. Each wing can accommodate one or more connectors and their associated tendons, with two or more connectors being preferred, with two connectors per wing being particularly preferred.

Suitable materials for making the substructure and elements thereof include, without limitation, metals such as iron or alloys thereof such as steel, stainless steel or the like, ceramics, plastics, concrete, aggregates, composites or other structural building materials.

Preferred Embodiments of Substructures of the Invention

Three Column Substructures

Figure 1B:
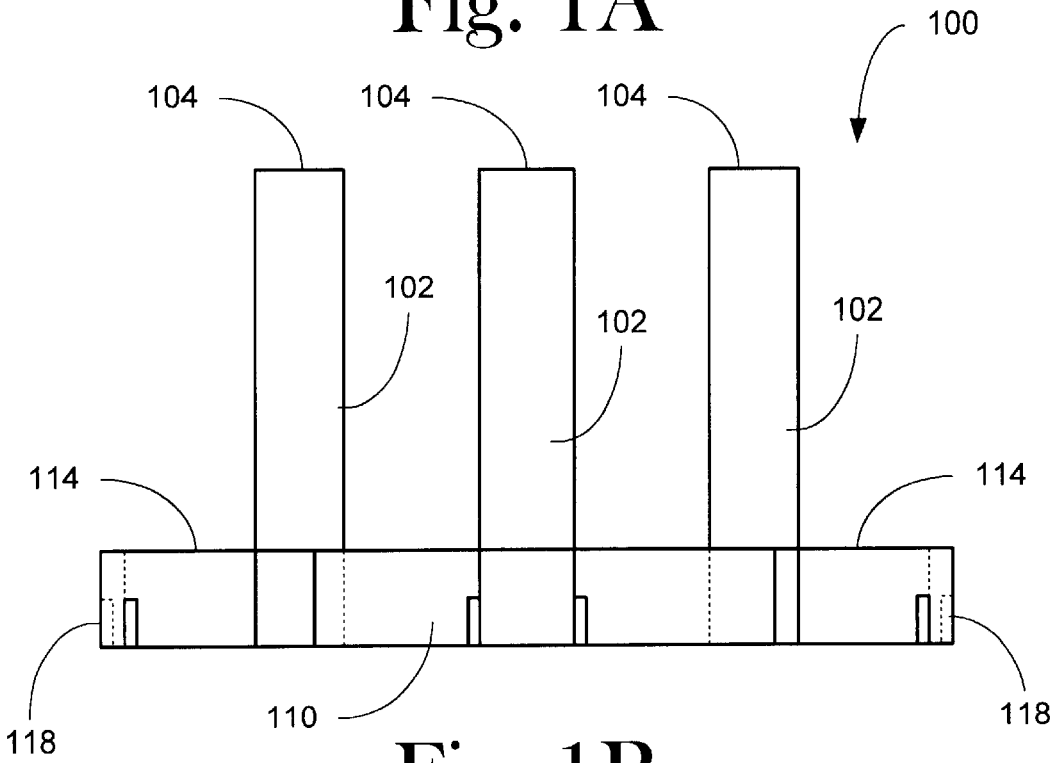
FIG. 1B schematically depicts a perspective view of the structure of FIG. 1A.

Referring now to FIGS. 1A and 1B, a first preferred embodiment of a compact TLP support substructure generally 100 is shown which includes three cylindrical, substantially vertically disposed columns 102 having top ends 104 designed to engage and support a platform (not shown). The columns 102 are symmetrically disposed about a central axis 106 and form an open central region 108 for improved access to well conduits, where the open region 108 is designed to allow access to subsea structure. In one preferred embodiment, the open region 108 has a sufficient moon pool dimension to accommodate conventional top tensioned risers and other equipment well known in the art. The spaced apart arrangement of the columns 102 provides improved wave transparency of the substructure 100 and improves the substructure's responses to wave, current and wind action.

The substructure 100 also includes at least one, substantially horizontally disposed pontoon 110 interconnecting adjacent columns 102 at their lower portions 112. Although the pontoon 110 is shown interconnecting adjacent columns 102 at their lower portions 112, the pontoon 110 can be positioned anywhere along the columns 102. The substructure 100 also includes at least one wing 114 radiating from each column 102, each wing 114 preferably having attached at opposing lateral surfaces 116 a tendon connector 118. Each connector 118 is designed to fixedly or removably secure one end of a tendon (not shown) the other end of which is secured to the seabed. The wings increase the distance between tendons thereby reducing tendon and tendon connection fatigue. Translational and rotational motion or heave, pitch, roll and yaw, are improved for the TLP substructure with a corresponding improvement in the fatigue life of the tendons and tendon connectors. Each column 102 and each pontoon 110 are individually and adjustably ballasted so that the tendons can be equally tensioned and the translational and rotational motion of an attached platform can be minimized or at least reduced.

Figure 1C:
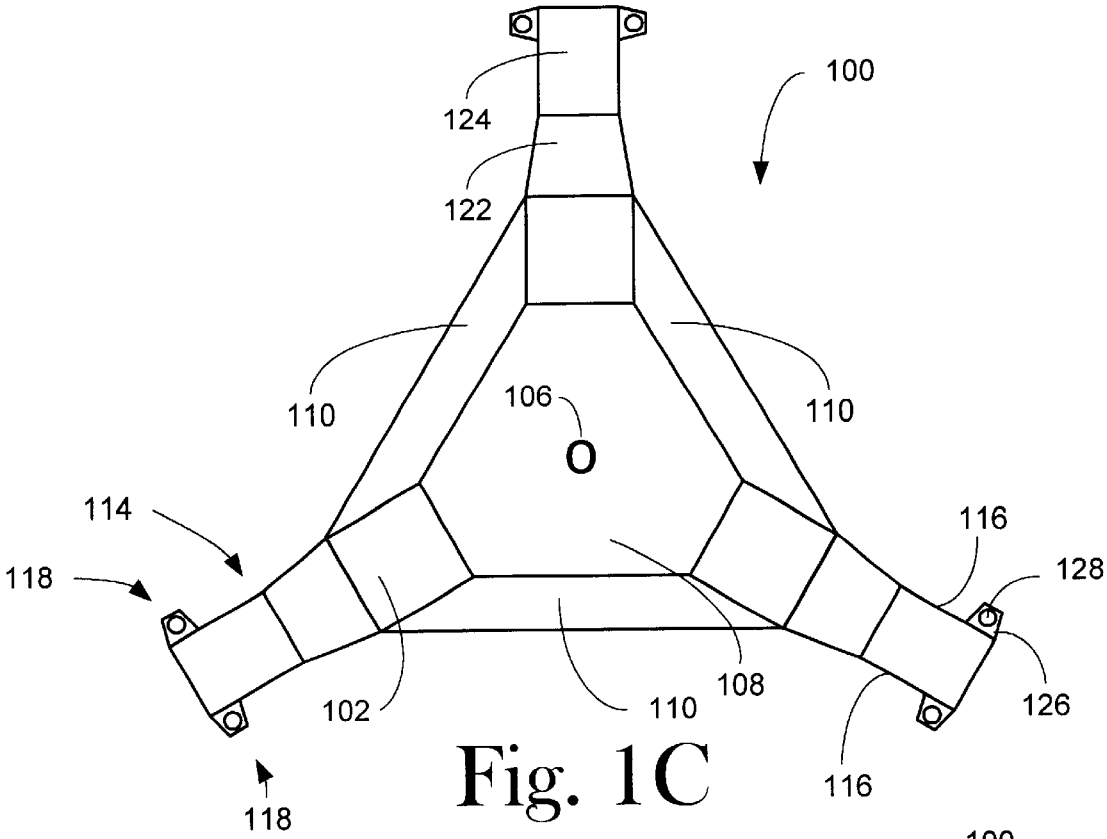
FIG. 1C depicts a top view of another preferred embodiment of an extended-base tension leg platform support structure in accordance with the present invention.

Referring now to FIGS. 1C and D, another preferred embodiment of the substructure 100 includes three substantially square columns 102 having an outward facing side 120 from which the wings 114 extend and trapezoidal pontoons 110 interconnecting the columns 102. The wings 114 are of any alternate design and include a trapezoidal proximal part 122 and a rectangular distal part 124. The connectors 118 are of an alternate design and include trapezoidal solid body 126 and a circular coupling 128 into which a tendon end is inserted.

Figure 1D:
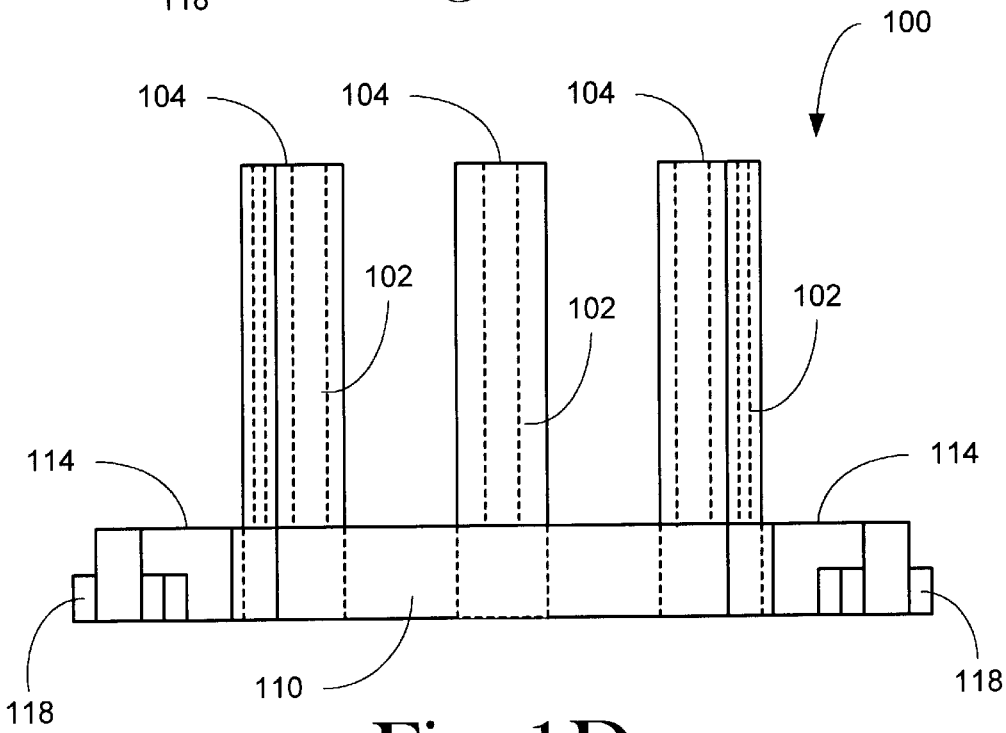
FIG. 1D a side view of the structure of FIG. 1C.
Figure 1E:
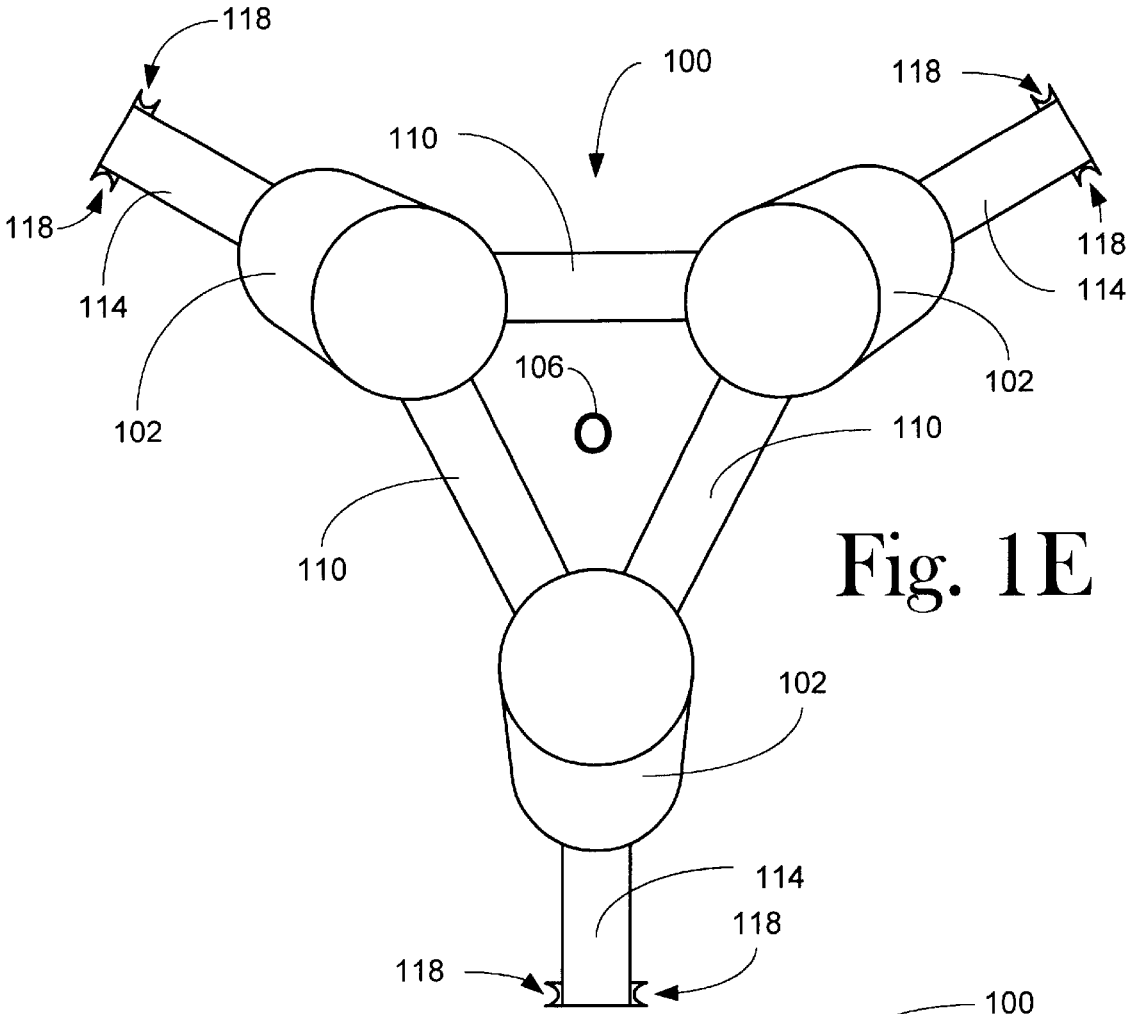
FIG. 1E depicts a top view of another preferred embodiment of an extended-base tension leg platform support structure in accordance with the present invention.
Figure 1F:
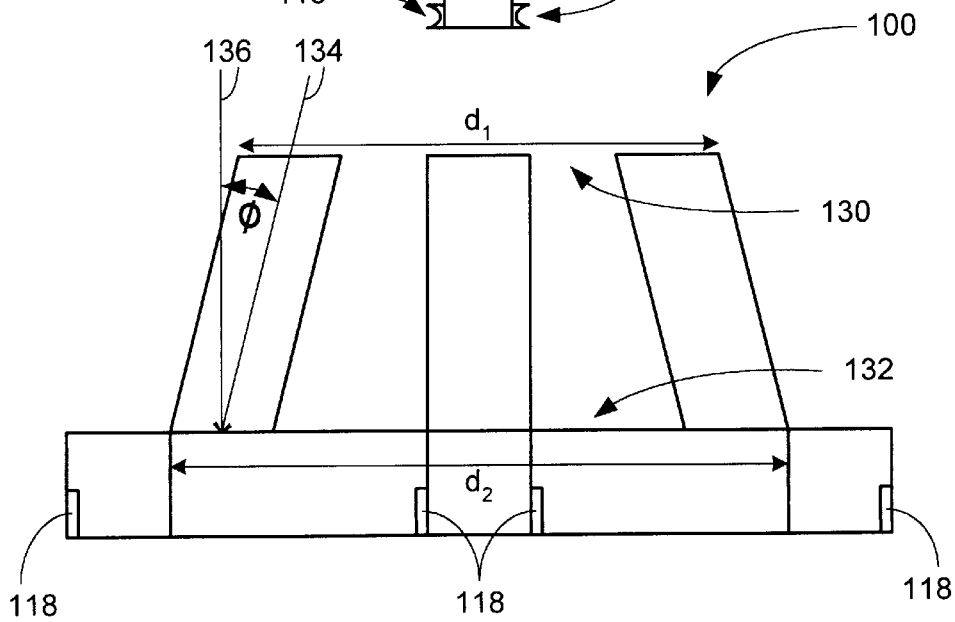
FIG. 1F a side view of the structure of FIG. 1E.

Although the columns 102 shown in FIGS. 1A–D are oriented in a substantially vertical orientation, the columns 102 can be angled with respect to a vertical axis as shown in FIGS. 1E and F. In an angled column arrangement, the columns 102 are preferably angled so that a column dimension $d_1$, at a top 130 of the substructure 100 is less than a column dimension $d_2$ at a bottom 132 of the columns 102 of the substructure 100. Generally, the angle $\phi$ made by an axis 134 associated with the column and a vertical axis 136 associated with the substructure is between about 90° (vertical) and about 45°, preferably the angle is between about 85° and about 50°, and particularly between about 80° and about 60°.

Figure 1G:
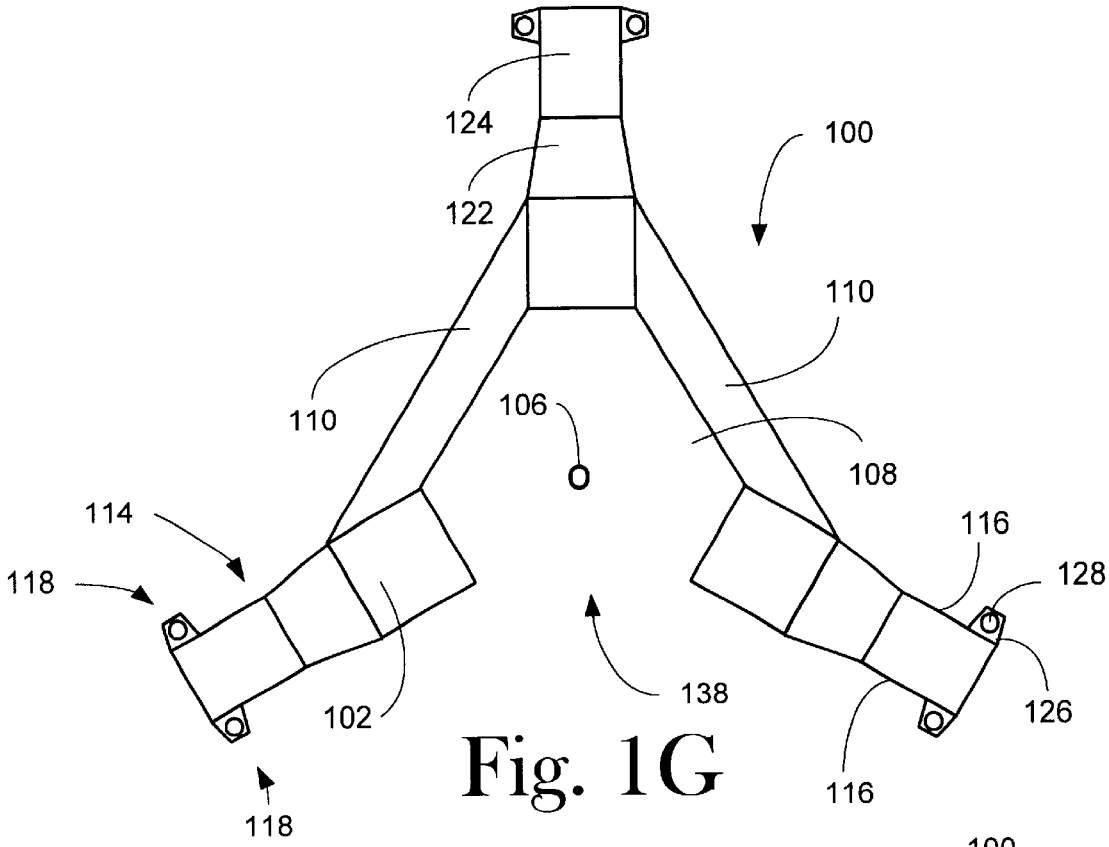
FIG. 1G depicts a top view of another preferred embodiment of an extended-base tension leg platform support structure in accordance with the present invention.
Figure 1H:
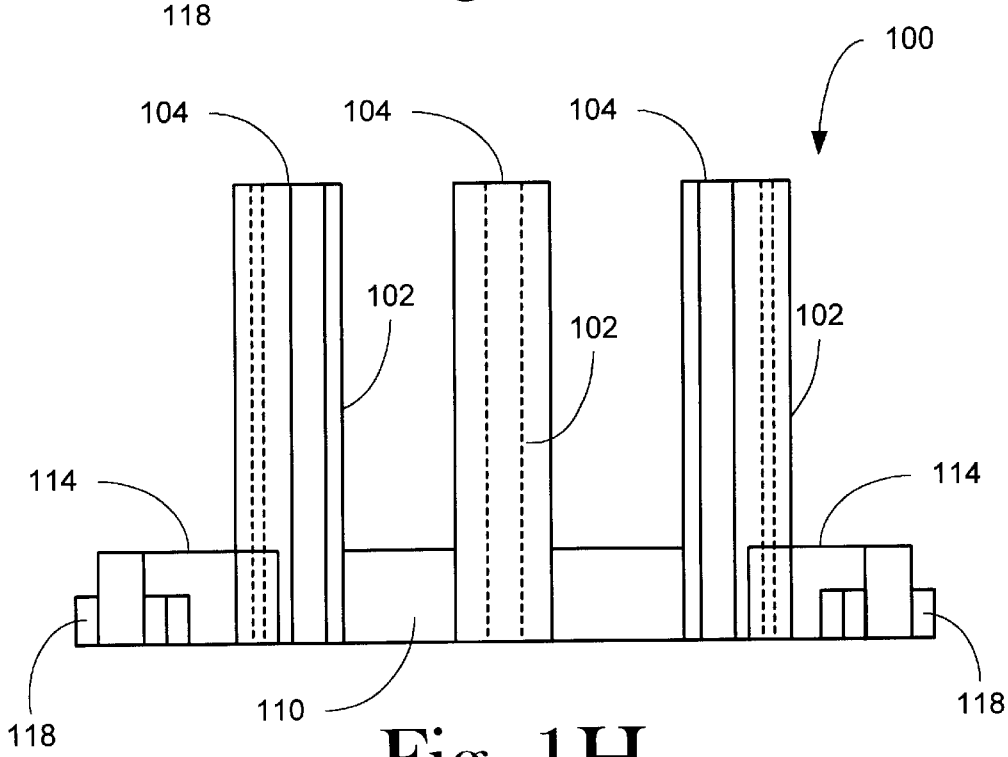
FIG. 1H a side view of the structure of FIG. 1G.

Referring now to FIGS. 1G and H, another preferred embodiment of the substructure 100 is shown absent an interconnecting pontoon(s) between two of the columns 102. In this arrangement, the open area 108 is directly accessible from a side entrance 138, i.e., the entrance 138 corresponds to the location of the missing interconnecting pontoon 110. Four Column Substructures Referring now to FIGS. 2A and 2B, another preferred embodiment of a compact TLP substructure is shown generally as 200. This substructure 200 includes four square sectioned elongated and substantially vertically disposed columns 202 having top ends 204 designed to support a platform (not shown). The columns 202 are symmetrically disposed about a central axis 206 and form an open central region 208 for improved access to well conduits where the open region 208 preferably has a sufficient moon pool dimension to accommodate conventional top tensioned risers and other equipment well-known in the art. The spaced apart arrangement of the columns 202 provides improved wave transparency of the substructure 200 and improves the substructure's response to wave, current and wind action.

The substructure 200 also includes at least one, substantially horizontally disposed pontoon 210 interconnecting adjacent columns 202 at their lower portions 212. The substructure 200 further includes at least one wing 214 radiating from each column 202, each wing 214 having top and bottom surfaces 216 and 218 for engaging an outboard edge or vertex 220 of the column 202. Each wing 214 also has attached at opposing lateral surfaces 222 a tendon connector 224. Each tendon connector 224 is designed to fixedly or removably secure one end of a tendon (not shown) the other end of which is secured to the seabed. The wings increase the distance between tendons thereby reducing tendon and tendon connection fatigue. Translational and rotational motion or heave, pitch, roll and yaw are improved for the TLP substructure with a corresponding improvement in the fatigue life of the tendons and their connectors. Each column 202 and each pontoon 210 are individually and adjustably ballasted so that the tendons can be equally tensioned and the translational and rotational motion of an attached platform can be minimized or at least reduced.

Figure 2A:
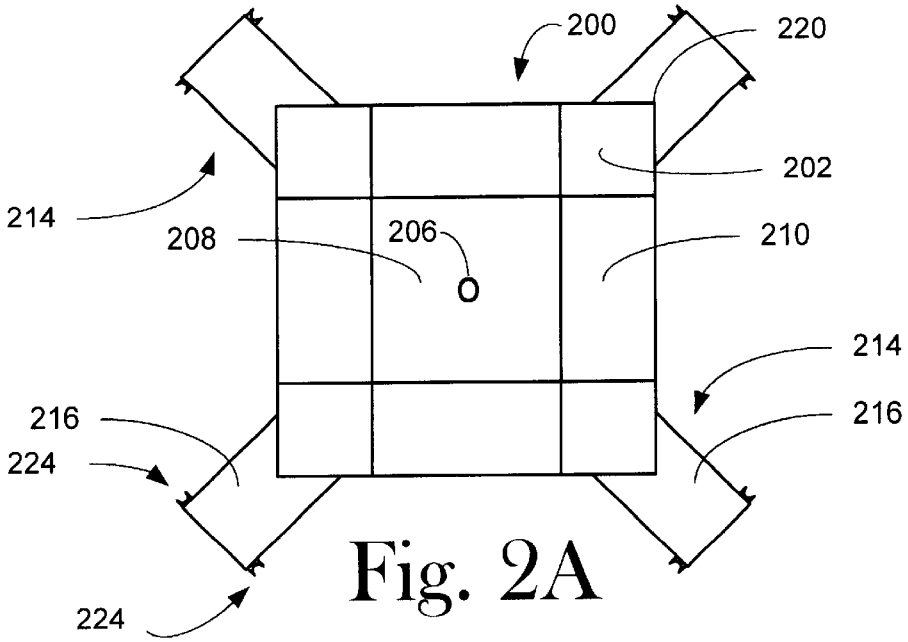
FIG. 2A depicts a top view of another preferred embodiment of an extended-base tension leg platform support structure in accordance with the present invention.
Figure 2B:
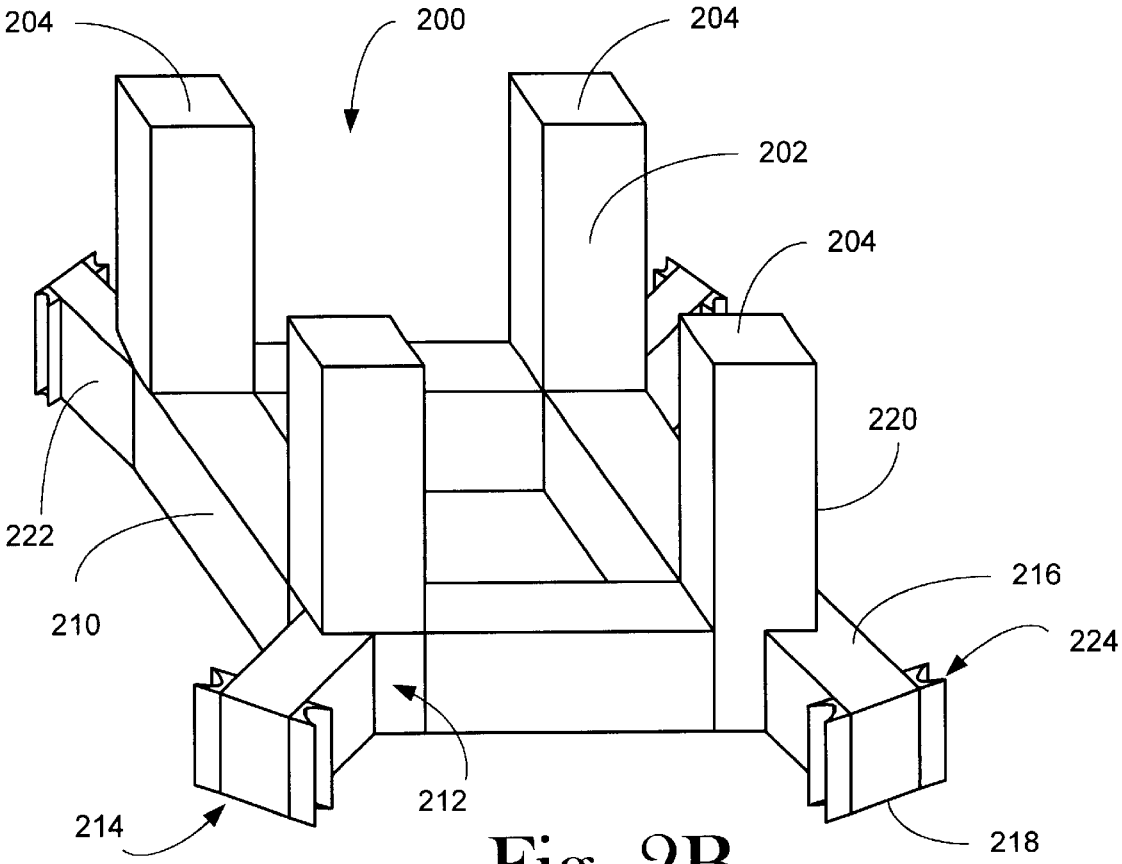
FIG. 2B schematically depicts a perspective view of the structure of FIG. 2A.
Figure 2C:
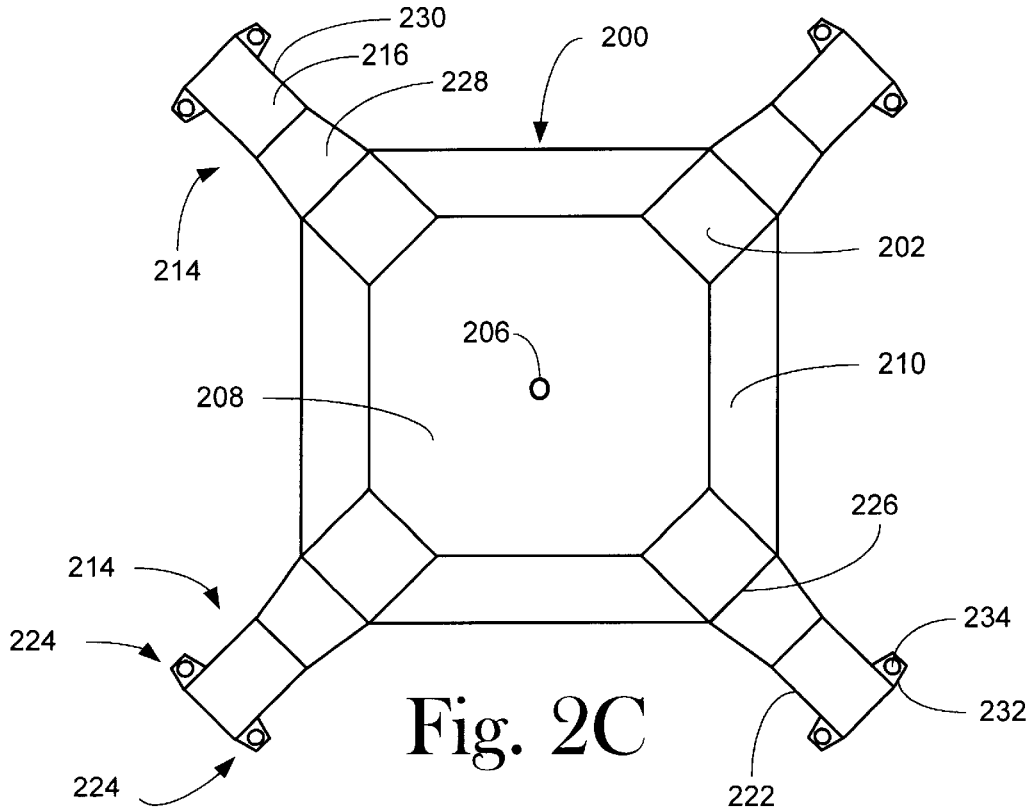
FIG. 2C depicts a top view of another preferred embodiment of an extended-base tension leg platform support structure in accordance with the present invention.

Referring now to FIGS. 2C and D, another preferred embodiment of a compact TLP substructure 200 is shown to include four substantially square, elongate and substantially vertically disposed support columns 202 which are rotated 450 with respect to the columns of FIGS. 2A and B. In this orientation, the wings 214 extend from an outward facing side 226 of each column 202 instead of from the outward facing vertex 220 in the embodiment of FIGS. 2A and B. The wings 214 of the embodiment of FIGS. 2C and D are of a composite structure including a trapezoidal proximal part 228 and a rectangular distal part 230. The connectors 224 are also shown in an alternate construction including a quadrilateral body 232 having a circular coupling 234 into which a tendon end inserts.

Figure 2E:
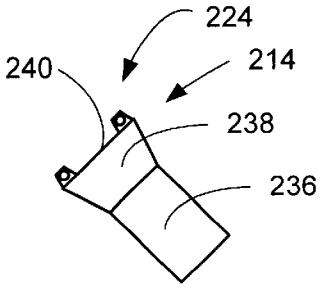
FIG. 2E a top view of an alternate wing design.
Figure 2D:
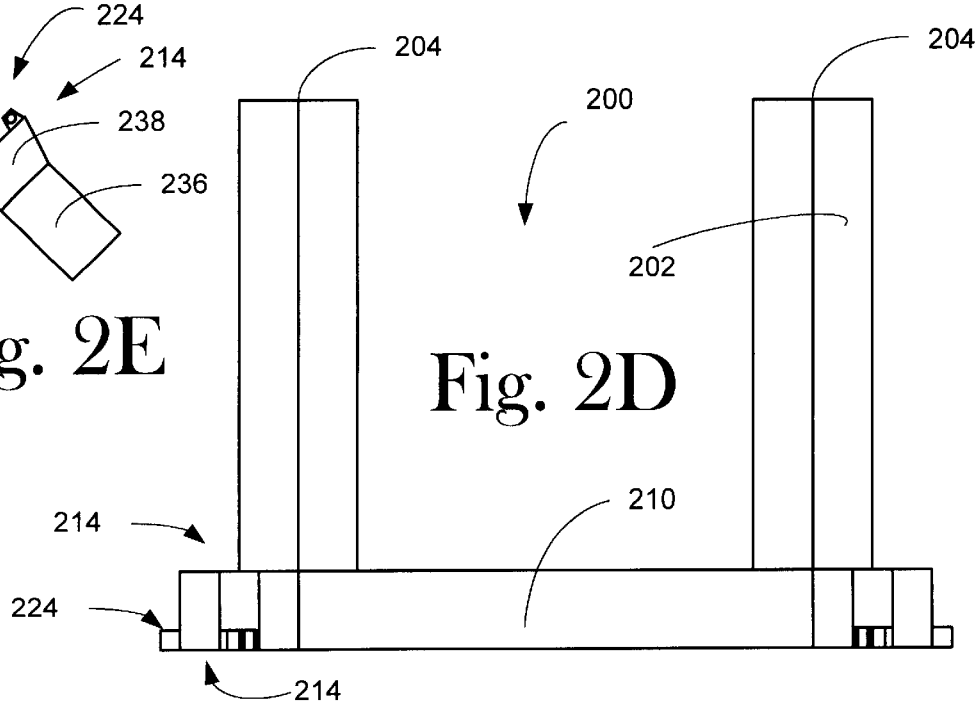
FIG. 2D depicts a side view of the structure of FIG. 2C.

An alternative wing arrangement is shown in FIG. 2E, where the wing 416 includes two parts: a substantially rectangular proximal part 236 and a trapezoidal distal part 238. The connectors 220 are attached to an outwardly facing side 240 of the trapezoidal part 224, which positions the connectors 220 on an outwardly end 242 of each wing 214 of the substructure 200. Of course, the trapezoidal part 238 can also be a square or rectangle.

Figure 3A:
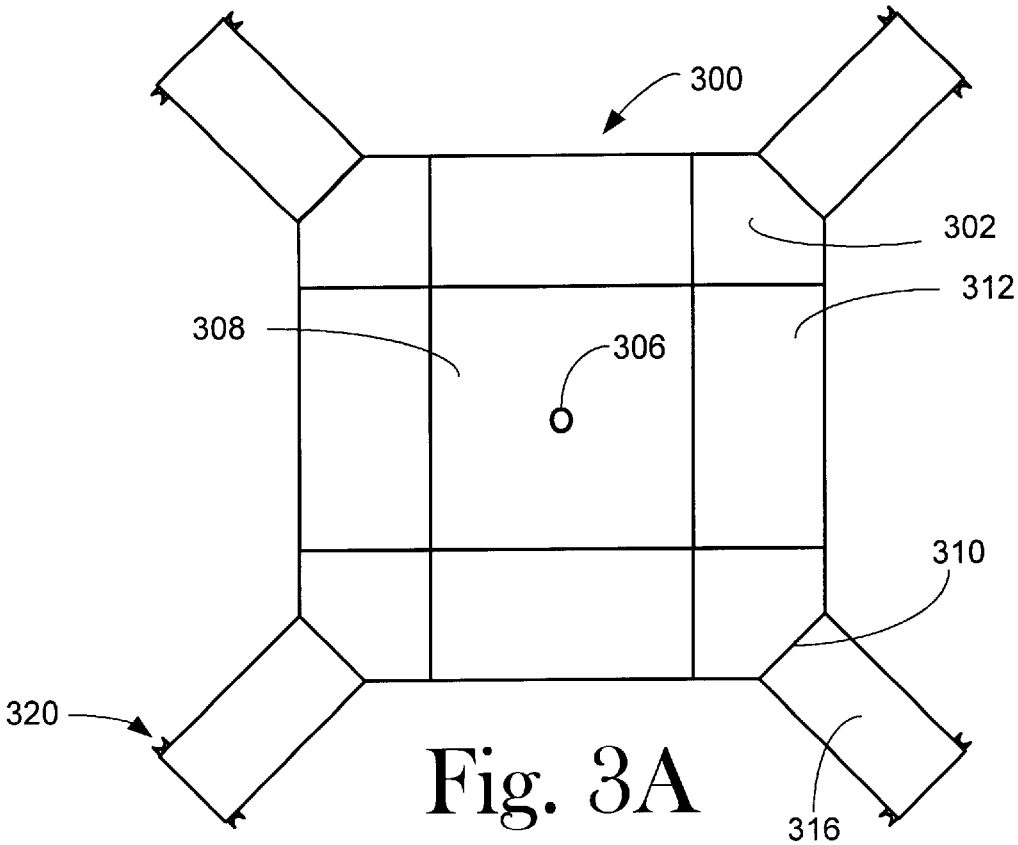
FIG. 3A depicts a top view of another preferred embodiment of an extended-base tension leg platform support structure in accordance with the present invention.
Figure 3B:
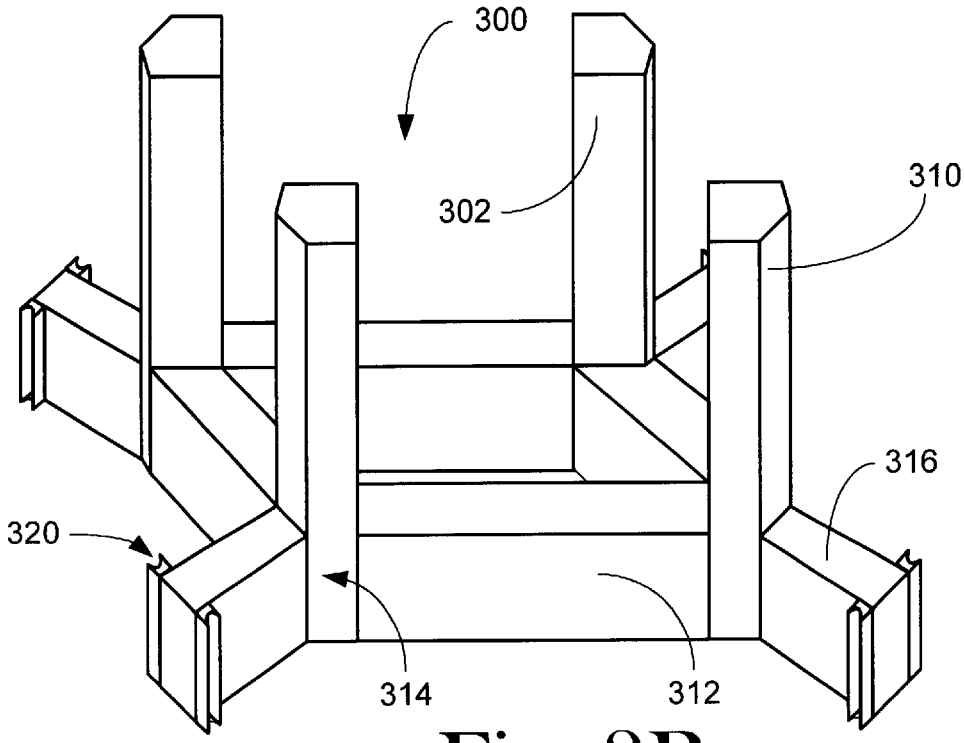
FIG. 3B schematically depicts a perspective view of the structure of FIG. 3A.

Referring now to FIGS. 3A and 3B, another preferred embodiment of a compact TLP substructure is shown generally as 300. The substructure 300 includes four five-sided, elongate and substantially vertically disposed support columns 302 having top ends 304 designed to support a platform (not shown). The support columns 302 are symmetrically disposed about a central axis 306 and form an open central region 308 for improved access to well conduits, where the open region 308 preferably has a sufficient moon pool dimension to accommodate conventional top tensioned risers and other equipment well-known in the art. Each column 302 includes one side 310 that faces generally outwardly relative to the axis 306 to facilitate attached of the wings 316. The spaced apart arrangement of the columns 302 provides improved wave transparency of the substructure 300 and improve the substructure's response to wave, current and wind action.

The substructure 300 also includes at least one, substantially horizontally disposed pontoon 312 interconnecting adjacent columns 302 at their lower portions 314. The substructure 300 further includes at least one wing 316 radiating from the outwardly facing side 310 of each column 302, each wing 316 having attached at opposing lateral surfaces 318 a tendon connector 320. Each tendon connector 320 is designed to fixedly or removably secure one end of a tendon (not shown) the other end of which is secured to the seabed. The wings increase the distance between tendons reducing tendon and tendon connection fatigue. Translational and rotational motion or heave, pitch, roll and yaw are improved for the TLP substructures with a corresponding improvement in the fatigue life of the tendons and their connectors. Each column 302 and each pontoon 312 are individually and adjustably ballasted so that the tendons can be equally tensioned and the translational and rotational motion of an attached platform can be minimized or at least reduced.

Figure 4A:
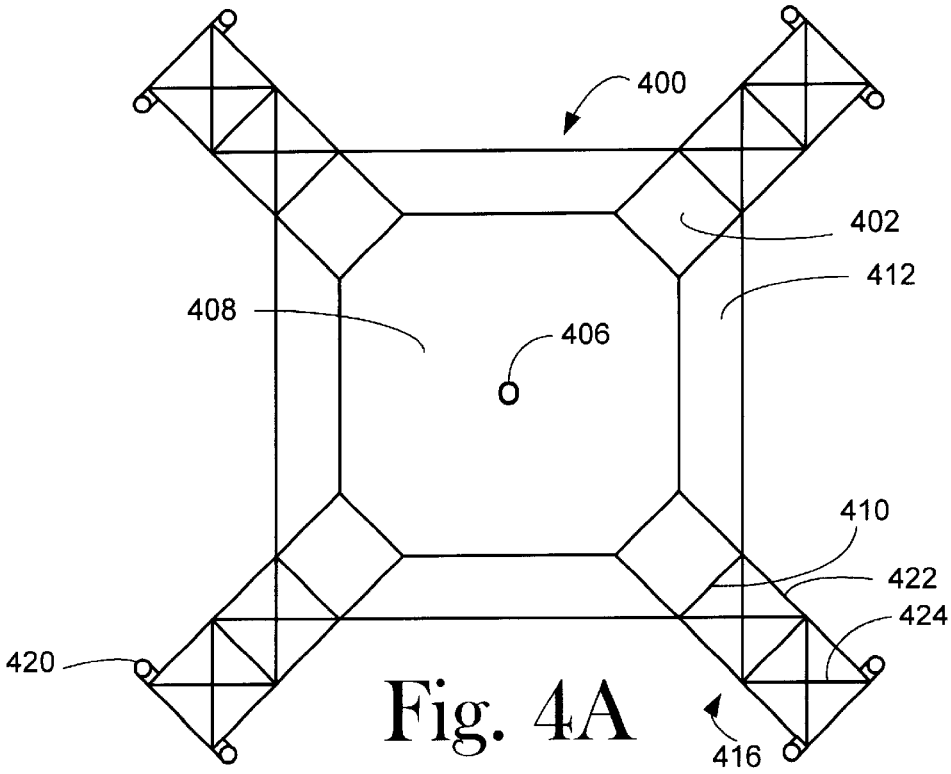
FIG. 4A depicts a top view of another preferred embodiment of an extended-base tension leg platform support structure in accordance with the present invention.
Figure 4B:
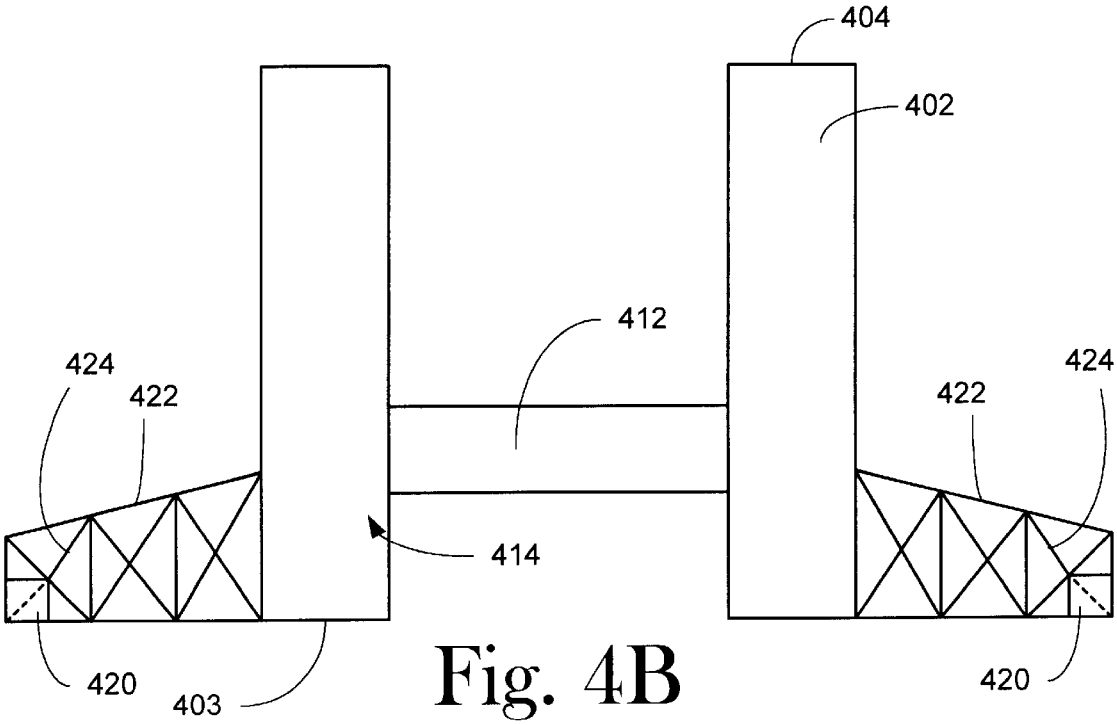
FIG. 4B depicts a side view of the structure of FIG. 4A.

Referring now to FIGS. 4A and 4B, another preferred embodiment of a compact TLP substructure is shown generally as 400. The substructure 400 includes four substantially square, elongate and substantially vertically disposed support columns 402 having top ends 404 designed to support a platform (not shown). The support columns 402 are symmetrically disposed about a central axis 406 and form an open central region 408 for improved access to well conduits or other subsea equipped. In one preferred embodiment, the open region 408 has a sufficient moon pool dimension to accommodate conventional top tensioned risers and other equipment well-known in the art. Each column 402 includes one side 410 that faces generally outwardly relative to the axis 406 to facilitate attached of the wings 416. The spaced apart arrangement of the columns 402 provides improved wave transparency of the substructure 400 and improve the substructure's response to wave, current and wind action.

The substructure 400 also includes at least one pontoon 412 interconnecting adjacent columns 402 at a position 414 above a bottom 403 of the columns 402. The substructure 400 further includes at least one wing 416 radiating from the outwardly facing side 410 of each column 402, each wing 416 having attached at an outward facing end 418 tendon connectors 420. Each tendon connector 420 is designed to fixedly or removably secure one end of a tendon (not shown) the other end of which is secured to the seabed. In this preferred embodiment, the wings 416 are open, truss or beam structure including outward beams 422 and cross beams 424.

The wings increase the distance between tendons reducing tendon and tendon connection fatigue. Translational and rotational motion or heave, pitch, roll and yaw are improved for the TLP substructures with a corresponding improvement in the fatigue life of the tendons and their connectors. Each column 402 and each pontoon 412 are individually and adjustably ballasted so that the tendons can be equally tensioned and the translational and rotational motion of an attached platform can be minimized or at least reduced.

Of course, the columns of the embodiments depicted in FIGS. 2A–D, 3A–B and 4A–B can also has angled columns as shown in FIGS. 1C–D. Moreover, all of the embodiments depict in Figures can include any of the wing designs and connectors individually or in any combination. Furthermore, any of the preferred embodiments can be constructed with an entrance into the open area be leaving out interconnection pontoons between a pair of columns.

Although the preferred embodiments illustrate three and four column substructures, it should be recognized by ordinary artisans that the number and shape of the columns and pontoons are a matter of design convenience and design criteria and are not a limitation on the scope of the inventions. Thus, substructures with three or more columns are also acceptable designs.

Preferred Embodiments of Substructures Supported Platforms of the Invention

Figure 5:
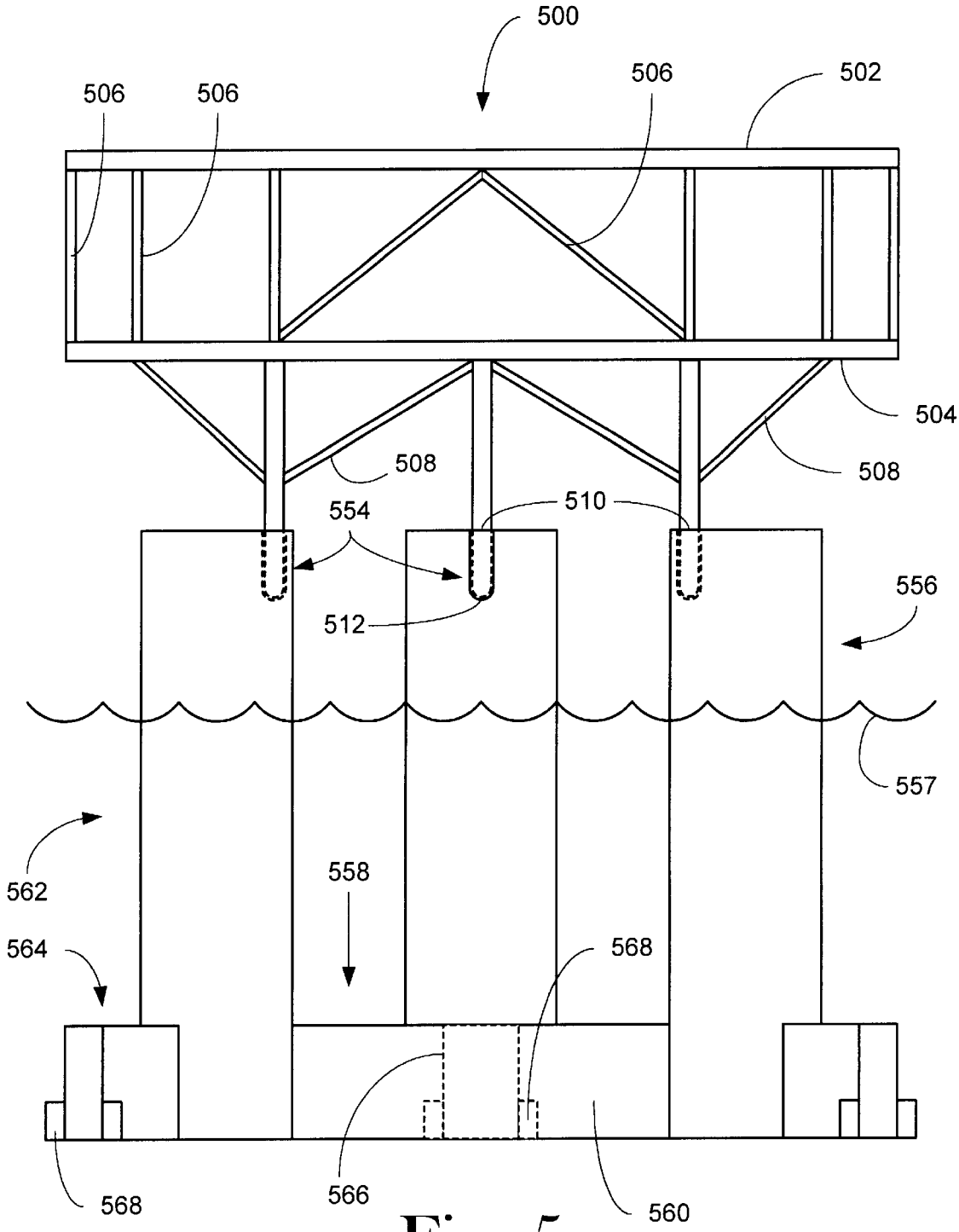
FIG. 5 depicts a preferred embodiment of an offshore platform incorporating the extended-base tension leg support structure of FIG. 1.

Referring now to FIG. 5, a preferred embodiment of an extended-base tension leg platform generally 500 supported by a compact platform support substructure generally 550 of the present invention is shown. The platform 500 includes a substantially flat top deck 502 supported on a sub-deck 504 by top deck support members 506. The sub-deck 504 is in turn supported by sub-deck support members 508 connecting to downwardly extending substantially vertical platform support members 510.

The substructure 550 includes three cylindrical support columns 552 having platform connectors 554 located on a top or above-water portion 556 of the columns 552 above a water line 557. The platform connectors 554 attachably engage the platform support members 510 at their distal ends 512. The columns 552 are symmetrically disposed about a central axis as shown in FIG. 1A and form an open central region 558 for improved access to well conduit where the open region 558 preferably has a sufficient moon pool dimension to accommodate conventional top tensioned risers and other well-related equipment. The spaced apart arrangement of the columns 552 provides improved wave transparency of the substructure 550.

The substructure 550 also includes at least one buoyant pontoon 560 interconnecting adjacent columns 552 at their lower or submerged parts 562. The substructure 550 also includes at least one wing 564 radiating from each column 552, each wing 564 having attached at opposing lateral surfaces 566 a tendon connector 568. Each connector 568 is designed to fixedly or removably engage a tendon (not shown) anchored on a seabed. The wings 564 are designed to increase the distance between tendons reducing tendon and tendon connection fatigue and reducing platform translational and rotational motion or heave, pitch, roll and yaw. Each column 552 and each pontoon 560 are individually and adjustably ballasted so that the tendons can be equally tensioned and the translational and rotational motion of an attached platform can be minimized or at least reduced.

Figure 6:
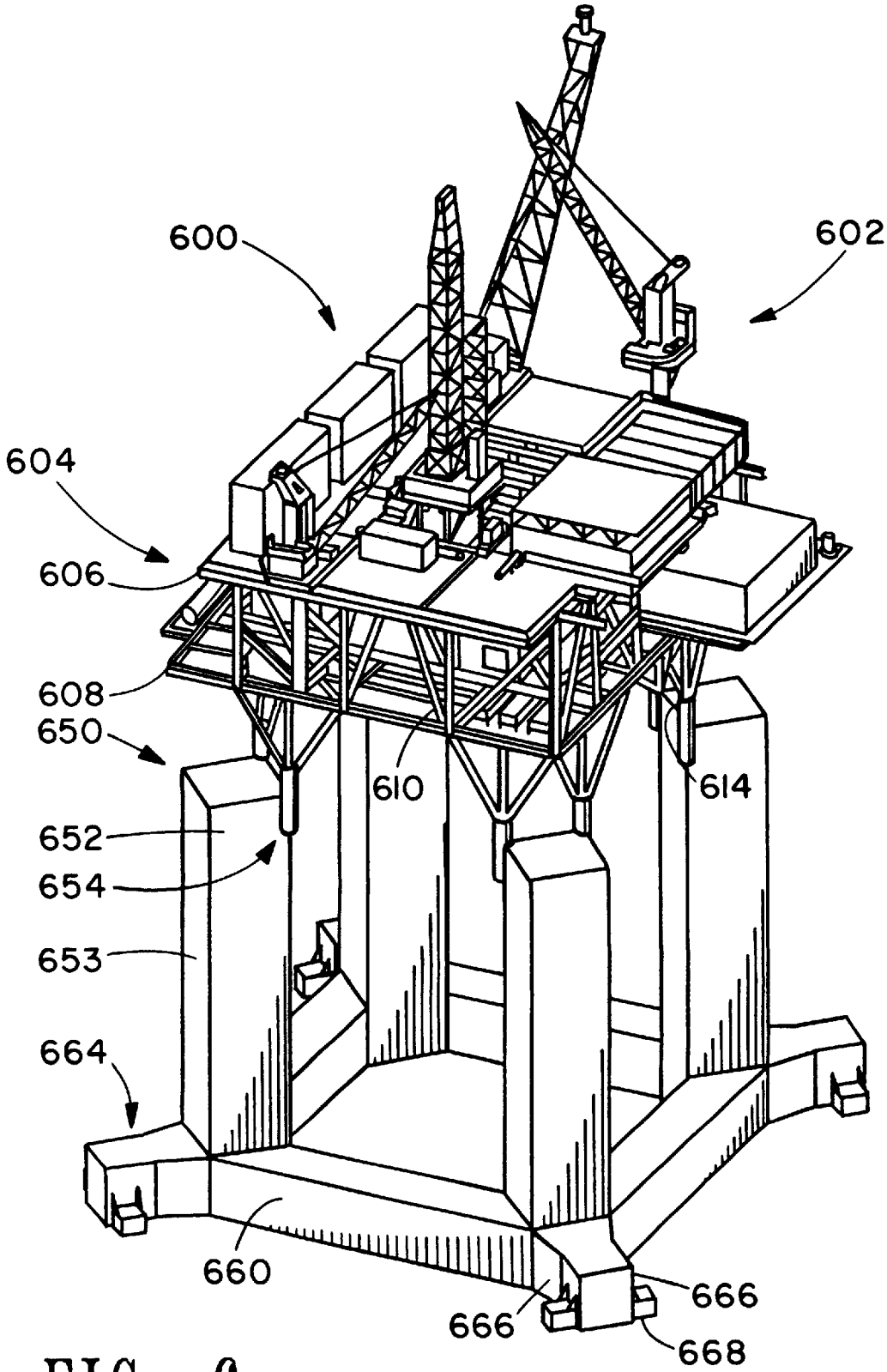
FIG. 6 depicts a preferred embodiment of an oil derrick supported on an offshore platform incorporating the extended-base tension leg support structure of FIG. 2C.

Referring now to FIG. 6, another preferred embodiment of an extended-base tension leg platform generally 600 is shown supported by a compact platform support substructure generally 650. The platform 600 includes an oil derrick 602 supported on a deck support structure 604. The deck support structure 604 includes a substantially flat top deck 606 supported on a sub-deck 608 by top deck support members 610. The sub-deck 604 is in turn supported by sub-deck support members 612 connecting to downwardly extending substantially vertical platform support members 614.

The substructure 650 includes four support columns 652 having platform connectors 654 located on a top or above-water portion 656 of the columns 652. The platform connectors 654 attachably engage the platform support members 614. The columns 652 are symmetrically disposed about a central axis as shown in FIG. 2C to form an open central region 658 for improved access to well conduits where the open region 658 preferably has a sufficient moon pool dimension to accommodate conventional top tensioned risers and other well-related equipment. The spaced apart arrangement of the columns 652 provides improved wave transparency of the substructure 650.

The substructure 650 also includes at least one buoyant pontoon 660 interconnecting adjacent columns 652 located at their bottom or below water parts 662. The substructure 650 further includes at least one wing 664 radiating from the outwardly facing side 653 of each column 652, each wing 664 having attached at opposing lateral surfaces 666 a tendon connector 668. Each connector 668 designed to fixedly or removably engage a seabed anchored tendon (not shown). The wings 664 increase the distance between tendons reducing tendon and tendon connection fatigue and reducing on the tendons and connections are reduced and reduce translational and rotational motion or heave, pitch, roll and yaw. Each column 652 and each pontoon 660 are individually and adjustably ballasted so that the tendons can be equally tensioned and the translational and rotational motion of an attached platform can be minimized or at least reduced.

Figure 7:
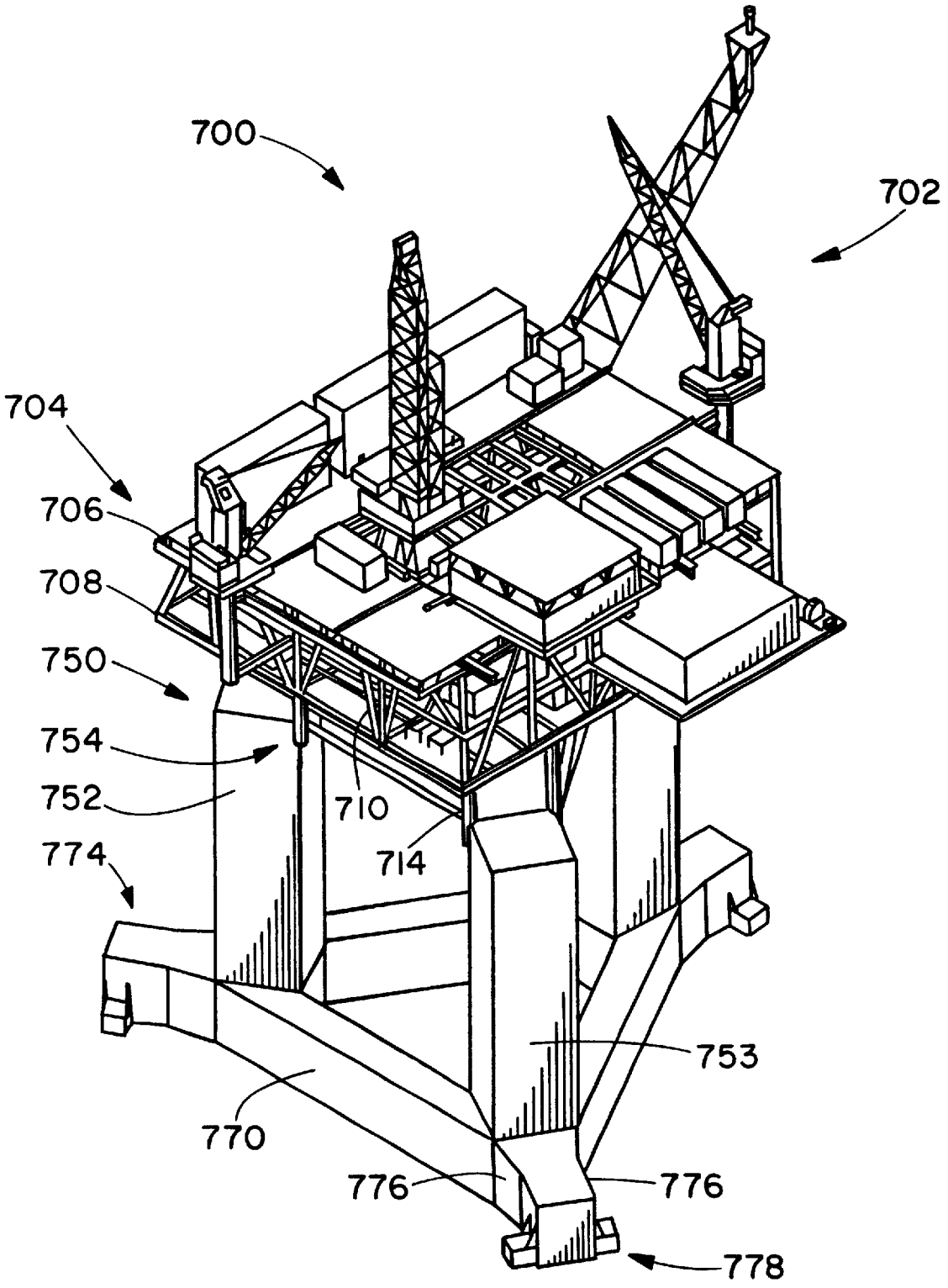
FIG. 7 depicts a preferred embodiment of an oil derrick supported on an offshore platform incorporating the extended-base tension leg support structure of FIG. 1C.

Referring now to FIG. 7, another preferred embodiment of an extended-base tension leg platform generally 700 is shown supported by a compact platform support substructure generally 750. The platform 700 includes an oil derrick 702 supported on a deck support structure 704. The deck support structure 704 includes a substantially flat top deck 706 supported on a sub-deck 708 by top deck support members 710. The sub-deck 604 is in turn supported by sub-deck support members 712 connecting to downwardly extending substantially vertical platform support members 714.

The substructure 750 includes three support columns 752 having platform connectors 754 located on a top or above-water portion 756 of the columns 752. The platform connectors 754 attachably engage the platform support members 714. The columns 752 are symmetrically disposed about a central axis as shown in FIG. 1C to form an open central region 758 for improved access to well conduits where the open region 758 preferably has a sufficient moon pool dimension to accommodate conventional top tensioned risers and other well-related equipment. The spaced apart arrangement of the columns 752 provides improved wave transparency of the substructure 750.

The substructure 750 also includes at least one buoyant pontoon 760 interconnecting adjacent columns 752 located at their bottom or below water parts 762. The substructure 750 further includes at least one wing 764 radiating from the outwardly facing side 753 of each column 752, each wing 764 having attached at opposing lateral surfaces 766 a tendon connector 768. Each connector 768 designed to fixedly or removably engage a seabed anchored tendon (not shown). The wings 764 increase the distance between tendons reducing tendon and tendon connection fatigue and reducing on the tendons and connections are reduced and reduce translational and rotational motion or heave, pitch, roll and yaw. Each column 752 and each pontoon 760 are individually and adjustably ballasted so that the tendons can be equally tensioned and the translational and rotational motion of an attached platform can be minimized or at least reduced.

Although the invention has been disclosed with reference to its preferred embodiments, from reading this description those of skill in the art may appreciate changes and modification that may be made which do not depart from the scope and spirit of the invention as described above and claimed hereafter.

We claim:

1. An extended-base tension leg platform substructure for an offshore platform comprising;

at least three buoyant support columns disposed about a central axis of the substructure to form an opening centered about the central axis;

a plurality of buoyant pontoons interconnecting at least some of the columns; and a plurality of wings or arms extending radially out from an outer perimeter of the substructure, each wing including at least one tendon connector affixed thereto, where the wings increase a radial extension of the substructure between about 10% and about 100%.

2. The substructure of claim 1, further comprising three columns triangularly disposed about the central axis.

3. The substructure of claim 2, wherein the wings extend radially from the columns.

4. The substructure of claim 1, further comprising four columns disposed about the central axis to form a quadrilateral.

5. The substructure of claim 4, wherein the quadrilateral is square, a rectangle or parallelogram.

6. The substructure of claim 5, wherein the quadrilateral is a square or rectangle.

7. The substructure of claim 6, wherein the wings extends radially from the columns.

8. The substructure of claim 6, wherein the wings comprise a closed structure, an open structure, or a mixture or combination of open parts and closed parts, and wherein the closed structures extends radially from the columns.

9. The substructure of claim 8, wherein the closed structure or closed parts are buoyant.

10. A platform structure comprising:

a platform including a plurality of connecting members affixed to a bottom surface of the platform;

a substructure for supporting the platform comprising:

at least three buoyant support columns disposed about a central axis of the substructure to form an opening centered about the central axis, where the columns include a plurality of platform connectors for engaging the platform connecting members;

a plurality of buoyant pontoons interconnecting at least some of the columns; and a plurality of wings or arms extending radially out from an outer perimeter of the substructure, each wing including at least one tendon connector affixed thereto, where the wings increase a radial extension of the substructure between about 10% and about 100%.

11. The substructure of claim 10, further comprising three columns triangularly disposed about the central axis.

12. The substructure of claim 11, wherein the wing extend radially from the columns.

13. The substructure of claim 10, further comprising four columns disposed about the central axis to form a quadrilateral.

14. The substructure of claim 13, wherein the quadrilateral is a square, rectangle or parallelogram.

15. The substructure of claim 14, wherein the quadrilateral is a square or rectangle.

16. The substructure of claim 15, wherein the wing extends radially from the columns.

17. The substructure of claim 10, wherein the wings comprise a closed structure, an open structure, or a mixture or combination of open parts and closed parts, and wherein the closed structures extends radially from the columns.

18. The substructure of claim 17, wherein the closed structure or closed parts are buoyant.

19. An extended-base tension leg platform comprising:

a platform including a plurality of connecting members affixed to a bottom surface of the platform;

a substructure for supporting the platform comprising:

at least three buoyant support columns disposed about a central axis of the substructure to form an opening centered about the central axis, where the columns include a plurality of platform connectors for engaging the platform connecting members;

a plurality of buoyant pontoons interconnecting at least some of the columns; and a plurality of wings or arms extending radially out from an outer perimeter of the substructure, each wing including at least one tendon connector affixed thereto, where the wings increase a radial extension of the substructure between about 10% and about 100%;

a plurality of tendons attachably engaging at their top ends the tendon connectors on each wing at their top ends; and a plurality of seabed anchor connections attachably engaging the tendons at their bottom ends.

20. The substructure of claim 19, further comprising three columns triangularly disposed about the central axis.

21. The substructure of claim 20, wherein the wings extend radially from the columns.

22. The substructure of claim 19, further comprising four columns disposed about the central axis to form a quadrilateral.

23. The substructure of claim 22, wherein the quadrilateral is a square, rectangle or parallelogram.

24. The substructure of claim 23, wherein the quadrilateral is a square or rectangle.

25. The substructure of claim 19, wherein the wings extend radially from the columns.

26. The substructure of claim 25, wherein the wings comprise a closed structure, an open structure, or a mixture or combination of open parts and closed parts. and wherein the closed structures extends radially from the columns.

27. The substructure of claim 26, wherein the closed structure or closed parts are buoyant.

28. A method for improving fatigue life of subsea tendons mooring an leg platform comprising the steps of:

forming a plurality of buoyant columns, interconnecting at least some of the columns with a plurality of generally horizontally disposed buoyant pontoons to form a substructure, attaching a plurality of arms about an outer perimeter of the substructure, the arms having a proximal end and a distal end, where the distal end includes a tendon porch, where the arms increase a radial extension of the substructure between about 10% and about 100%, securing one end of the tendons to the distal end of each of the arms, and securing the other end of the tendons to the seabed.

* * * * *